US008771008B1

(12) United States Patent
Black et al.

(10) Patent No.: US 8,771,008 B1
(45) Date of Patent: Jul. 8, 2014

(54) ELECTRICAL POWER OUTLET

(75) Inventors: Dave Black, Orange, CT (US); Robert A. Love, Bloomfield, CT (US)

(73) Assignee: Premier Manufacturing Group, Inc., Shelton, CT (US)

( * ) Notice: Subject to any disclaimer, the term of this patent is extended or adjusted under 35 U.S.C. 154(b) by 0 days.

(21) Appl. No.: 13/476,979

(22) Filed: May 21, 2012

Related U.S. Application Data

(60) Provisional application No. 61/490,502, filed on May 26, 2011, provisional application No. 61/580,854, filed on Dec. 28, 2011.

(51) Int. Cl.
*H01R 13/60* (2006.01)

(52) U.S. Cl.
USPC ..... 439/535

(58) Field of Classification Search
USPC ..... 439/535–536, 76.1, 34–35, 362, 954, 439/354; 174/53–54, 65 R
See application file for complete search history.

(56) References Cited

U.S. PATENT DOCUMENTS 4,990,094 A * 2/1991 Chandler et al. ..... 439/108
5,122,069 A * 6/1992 Brownlie et al. ..... 439/131
5,599,190 A * 2/1997 Willette ..... 439/49
5,665,939 A * 9/1997 Jorgensen et al. ..... 174/50.52
5,998,734 A * 12/1999 Kerestan et al. ..... 174/53
7,004,795 B2 2/2006 Mancini
7,404,735 B2 * 7/2008 Reker et al. ..... 439/540.1
7,407,410 B1 * 8/2008 Benoit et al. ..... 439/535
7,529,458 B2 * 5/2009 Spisany et al. ..... 385/137
D604,246 S 11/2009 Mancini
7,749,018 B1 * 7/2010 Benoit et al. ..... 439/535
7,762,838 B2 * 7/2010 Gorman ..... 439/536
8,172,583 B2 * 5/2012 Friedrich ..... 439/76.1

* cited by examiner

*Primary Examiner* — Jean F Duverne
(74) *Attorney, Agent, or Firm* — Raymond A. Nuzzo

(57) ABSTRACT

An electrical power outlet having an outlet box and an electrical connector insert attached to the outlet box. The electrical connector insert has a frame and a powerpole connector assembly attached to the frame. The powerpole connector assembly has a plurality of powerpole connectors. The electrical power outlet includes a face plate that is attached to the frame of the electrical connector insert. The faceplate has an opening through which the powerpole connectors protrude. In one embodiment, the plurality of powerpole connectors has four powerpole connectors arranged in two columns, wherein each column has two powerpole connectors. The opening in the face plate is substantially rectangular in shape. In a preferred embodiment, the face plate is configured as a Decora® style face plate.

2 Claims, 7 Drawing Sheets

ELECTRICAL POWER OUTLET

CROSS-REFERENCE TO RELATED APPLICATIONS

This application claims the benefit of U.S. provisional application No. 61/490,502, filed May 26, 2011, and U.S. provisional application No. 61/580,854, filed Dec. 28, 2011.

BACKGROUND OF THE INVENTION

The present invention relates to electrical power outlets that provide voltages, such as AC voltages, that can be used to power equipment or machinery.

SUMMARY OF THE INVENTION

It is an object of the present invention to provide a new electrical power outlet that has the capability to provide a plurality of different voltages.

In one aspect, the present invention is directed to an electrical power outlet comprising an outlet box and an electrical connector insert attached to the outlet box. The electrical connector insert comprises a frame and a powerpole connector assembly attached to the frame. The powerpole connector assembly comprises a plurality of powerpole connectors. The electrical power outlet further comprises a face plate that is attached to the frame of the electrical connector insert. The faceplate has an opening through which the powerpole connectors protrude. In one embodiment, the plurality of powerpole connectors comprises four powerpole connectors arranged in two columns, wherein each column has two powerpole connectors. The opening in the face plate is substantially rectangular in shape. In a preferred embodiment, the face plate is configured as a Decora® style face plate.

Other objects and advantages of the present invention will be apparent in view of the ensuing description of the present invention.

BRIEF DESCRIPTION OF THE DRAWINGS

Although the scope of the present invention is much broader than any particular embodiment, a detailed description of the preferred embodiments follows together with illustrative figures, wherein like reference numerals refer to like components, and wherein.

DESCRIPTION OF THE PREFERRED EMBODIMENT

Figure 1:
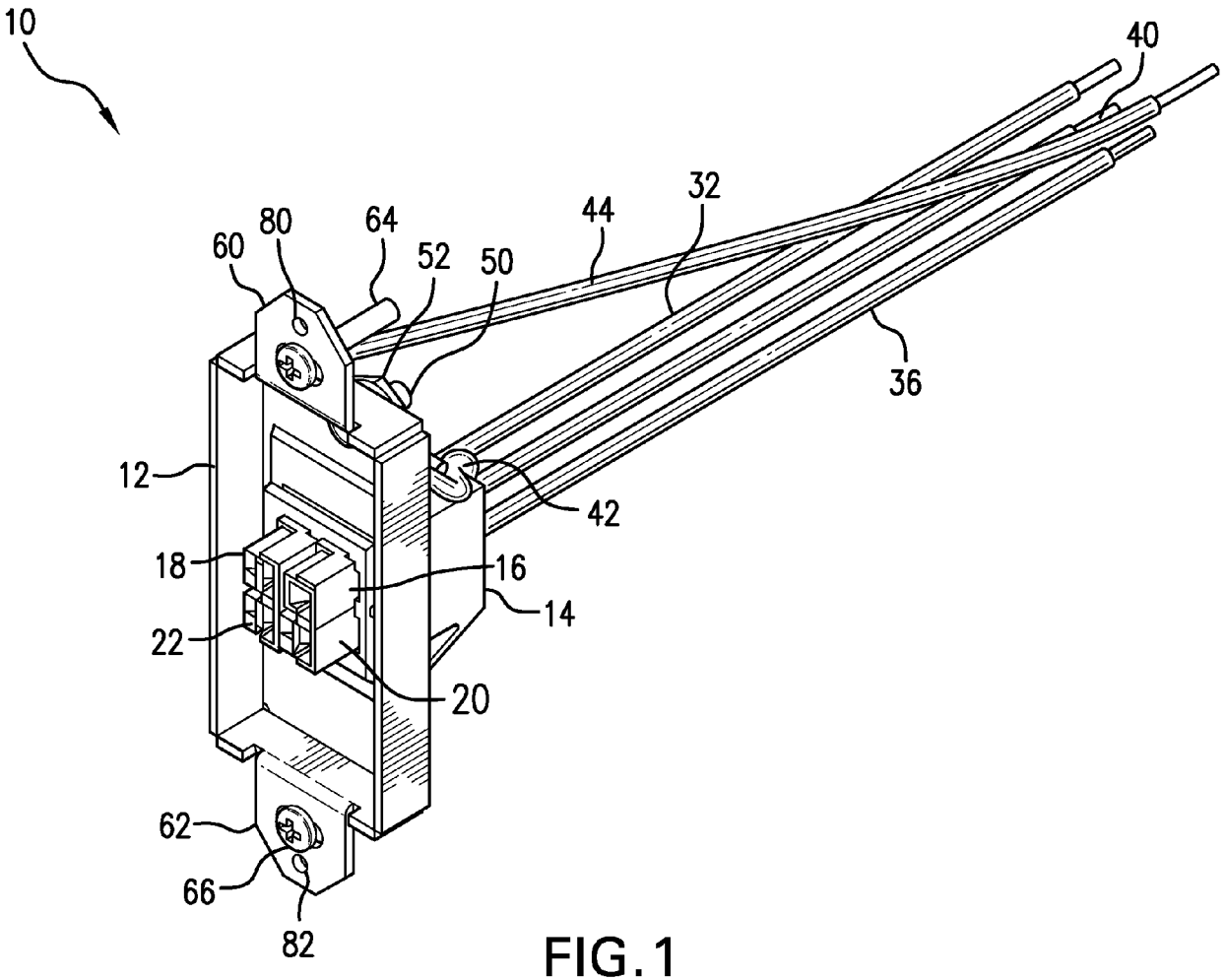
FIG. 1 is a perspective view of an electrical connector insert that is part of the electrical power outlet of the present invention.
Figure 2:
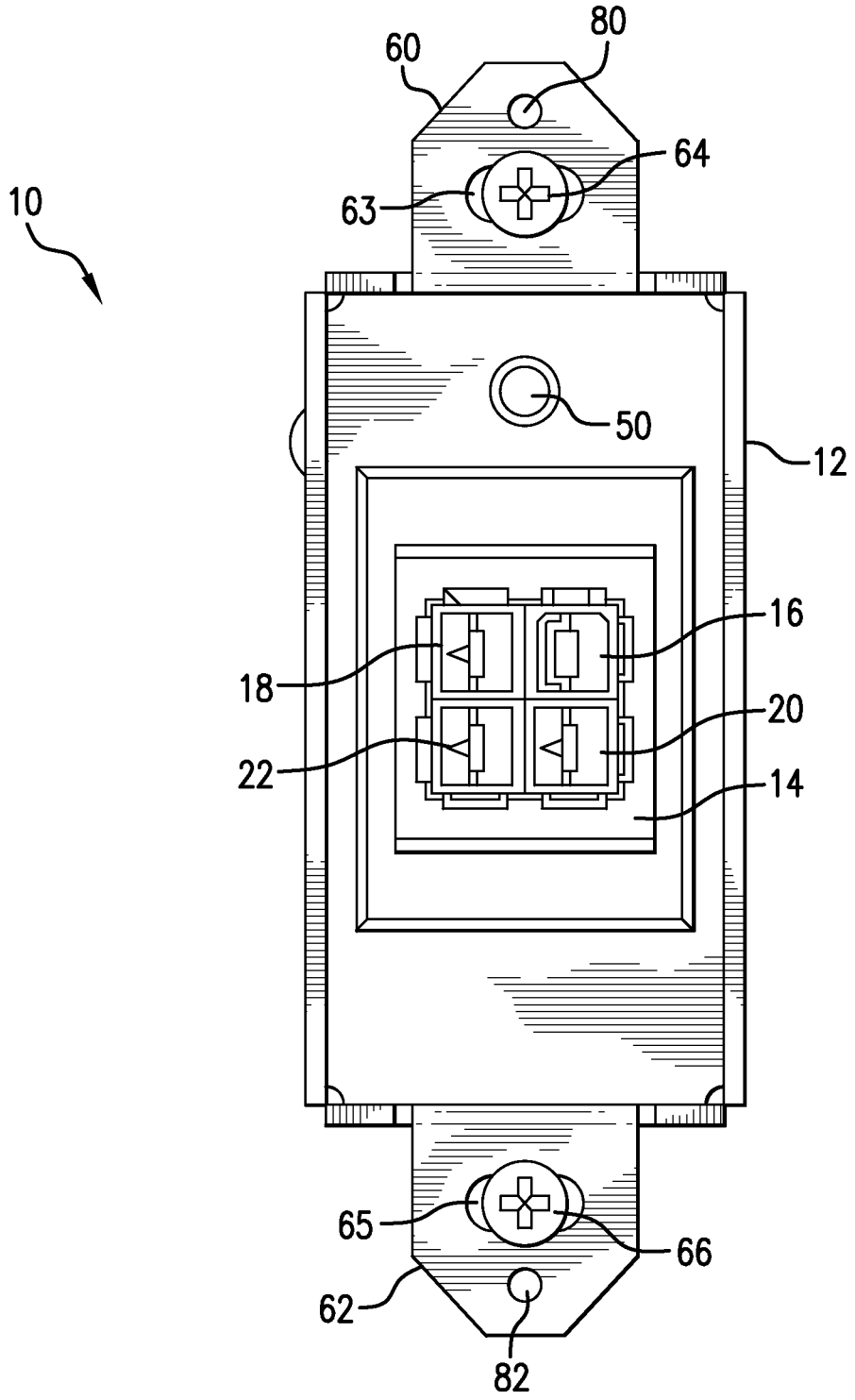
FIG. 2 is a front view of the electrical connector insert shown in FIG. 1.
Figure 3:
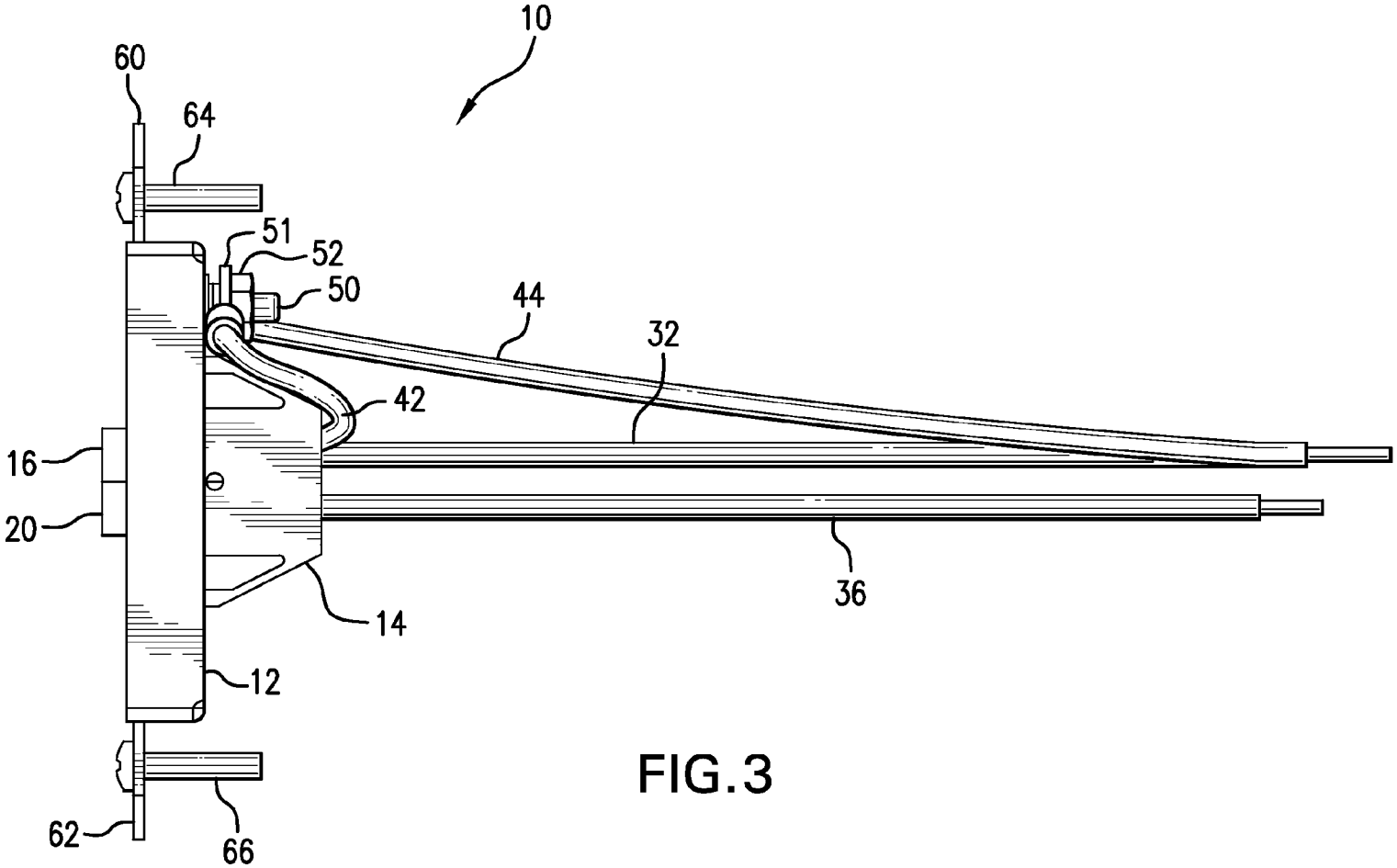
FIG. 3 is a side view, in elevation, of the electrical connector insert shown in FIG. 1.

Referring to FIGS. 1-5, there is shown electrical connector insert 10 that is part of the electrical power outlet of the present invention. Electrical connector insert 10 comprises frame 12 and electrical connector assembly 14. Electrical connector assembly 14 comprises a plurality of electrical connectors 16, 18, 20 and 22. Electrical connector assembly 14 is connected to frame 12. Specifically, frame 12 has a generally central opening in which is located electrical connector assembly 14 such that electrical connectors 16, 18, 20 and 22, protrude outward. Any suitable technique may be used to connect electrical connector assembly 14 to frame 12.

In accordance with the invention, electrical connector assembly 14 is configured as a Powerpole® connector assembly manufactured by Anderson Power Products, Inc. of Sterling, Mass. A powerpole connector assembly is described and shown in U.S. Pat. No. 7,004,795 entitled "Powerpole Connector Assembly And Method Therefor", the disclosure of which patent is hereby incorporated by reference. A powerpole connector is also shown in U.S. Pat. No. D604,246, entitled "Electrical Connector", the disclosure of which patent is hereby incorporated by reference. The mark "Powerpole" is a trademark owned by Anderson Power Products, Inc. and is known in the art. In accordance with the invention, each electrical connector 16, 18, 20 and 22 is configured as a "Powerpole" connector (or "powerpole").

Figure 4:
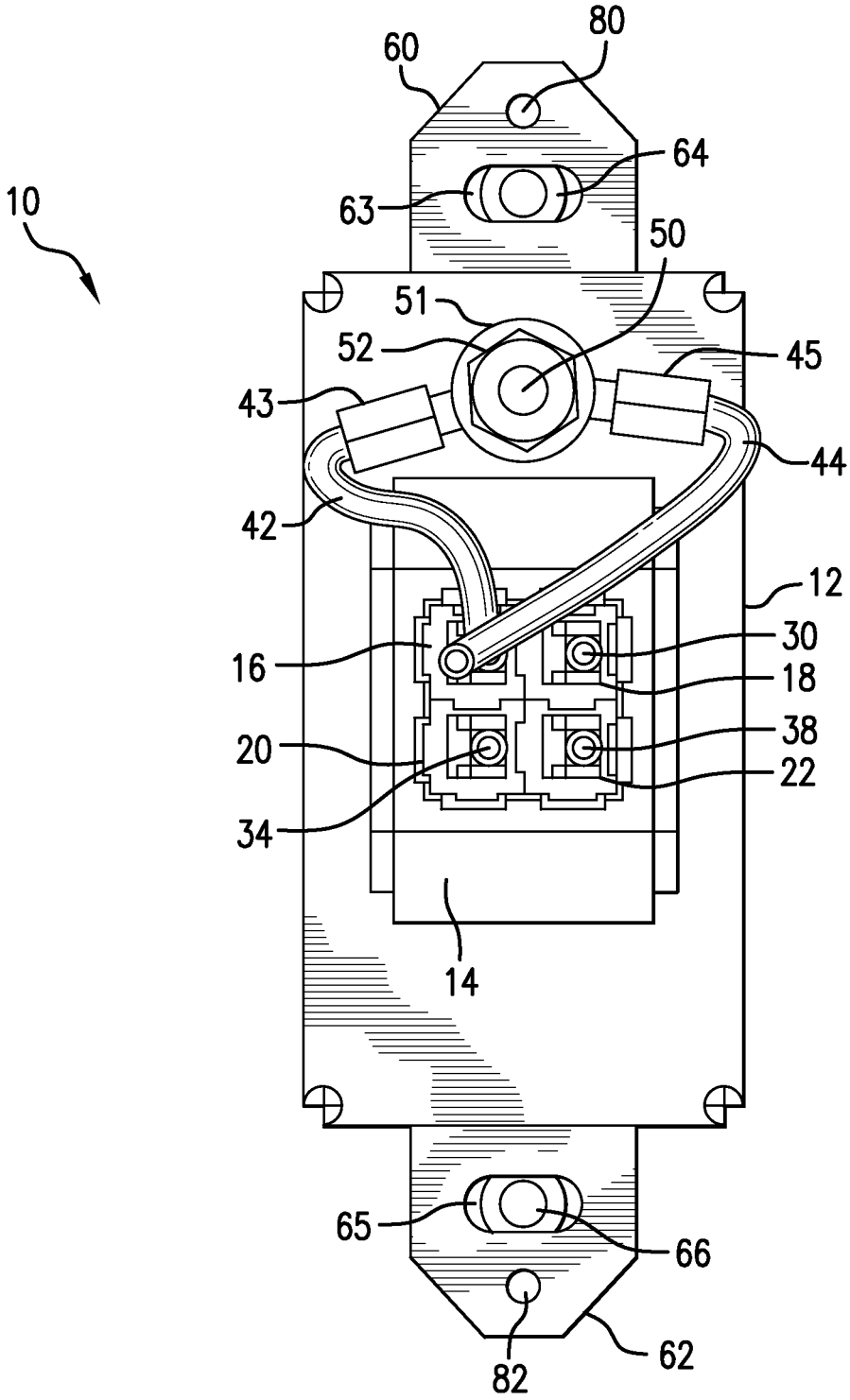
FIG. 4 is a rear view of the electrical connector insert of FIG. 1.
Figure 5:
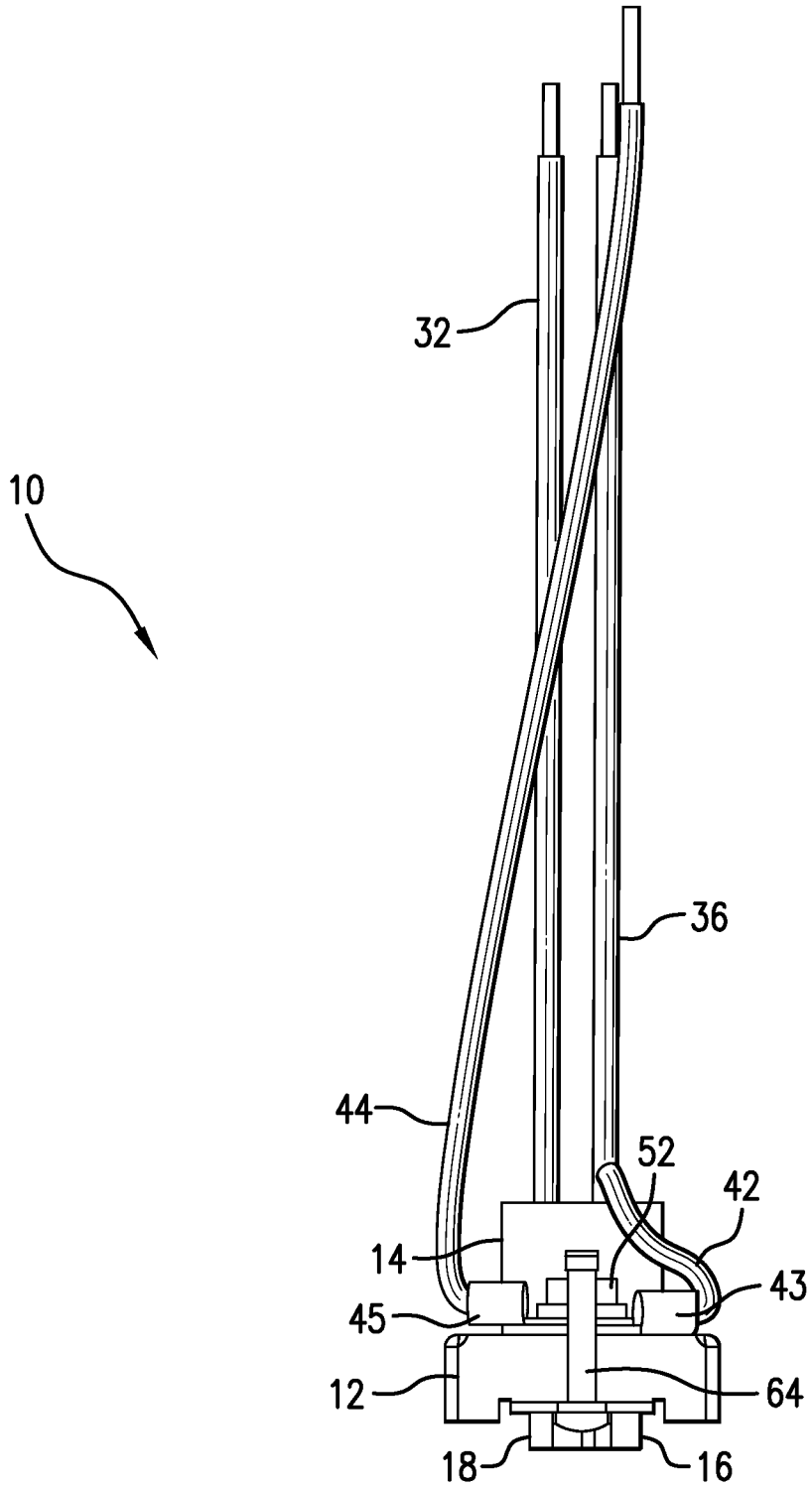
FIG. 5 is a top view of the electrical connector insert of FIG. 1.
Figure 6:
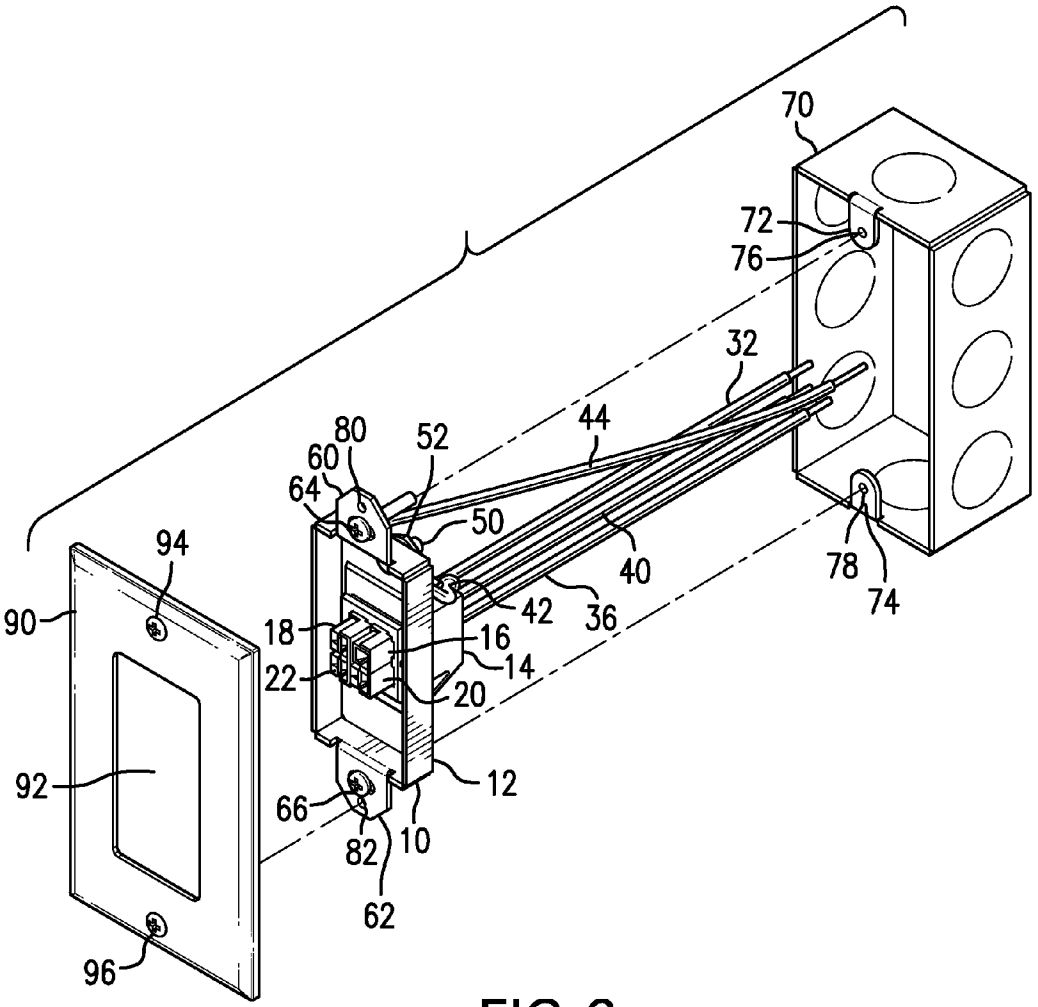
FIG. 6 is an exploded view, in perspective view, of the electrical power outlet of the present invention.

Each electrical connector, or Powerpole connector, provides either a ground connection or a specific voltage. For example, in one embodiment, electrical connector 16 provides a connection to electrical ground, electrical connector 18 provides 24 VAC (volts alternating current), electrical connector 20 provides 72 VAC, and electrical connector 22 provides 80 VAC. It is to be understood that these voltages are just examples. Referring to FIG. 4, there is shown a rear view of electrical connector insert 12. Each electrical connector 16, 18, 20 and 22 has a wire receiving channel for receiving a corresponding electrical wire. Once the wire is inserted into the wire receiving channel, it is locked in place. Specifically, electrical connector 18 has wire receiving channel 30 for receiving wire 32 (see FIG. 1). Electrical connector 20 has wire receiving channel 34 for receiving wire 36. Similarly, electrical connector 22 has wire receiving channel 38 for receiving wire 40. Electrical connector 16 has a wire receiving channel, that is not shown, but which receives wire 42. Wire 42 is also connected to frame 12. Wire 42 includes ring terminal 43. Thus, in this embodiment, electrical connector 16 is connected to ground. Wire 44 is also connected to frame 12. Wire 44 includes ring terminal 45. Frame 12 includes PEM stud 50, tooth washer 51 and nut 52. Ring terminals 43 and 45 are positioned on PEM stud 50. Tooth washer 51 is positioned on PEM stud 50 and over ring terminals 43 and 45. Nut 52 is then threaded on PEM stud 50 and tightened to create a high-integrity ground connection. Frame 12 includes extending portions 60 and 62. Extending portion 60 has an opening 63 for receiving screw 64. Similarly, extending portion 62 has an opening 65 for receiving screw 66. As shown in FIG. 6, the electrical power outlet of the present invention includes outlet box 70 which is well known in the art. Outlet box 70 is typically connected to a structure (not shown) such as a wall, post, support beam, etc. Outlet box 70 can also be attached to a table, work bench or other article of furniture, or to a machine. Outlet box 70 includes portions 72 and 74 which have threaded openings 76 and 78, respectively. Threading openings 76 and 78 are configured to receive screws 64 and 66, respectively, thereby allowing electrical connector insert 10 to be fastened to outlet box 70. Electrical wires (not shown) carrying specific voltages are connected to wires 32, 36 and 40 within outlet box 70. An additional electrical wire (not shown), which is connected to ground, is connected to wire 44 within outlet box 70.

Figure 7:
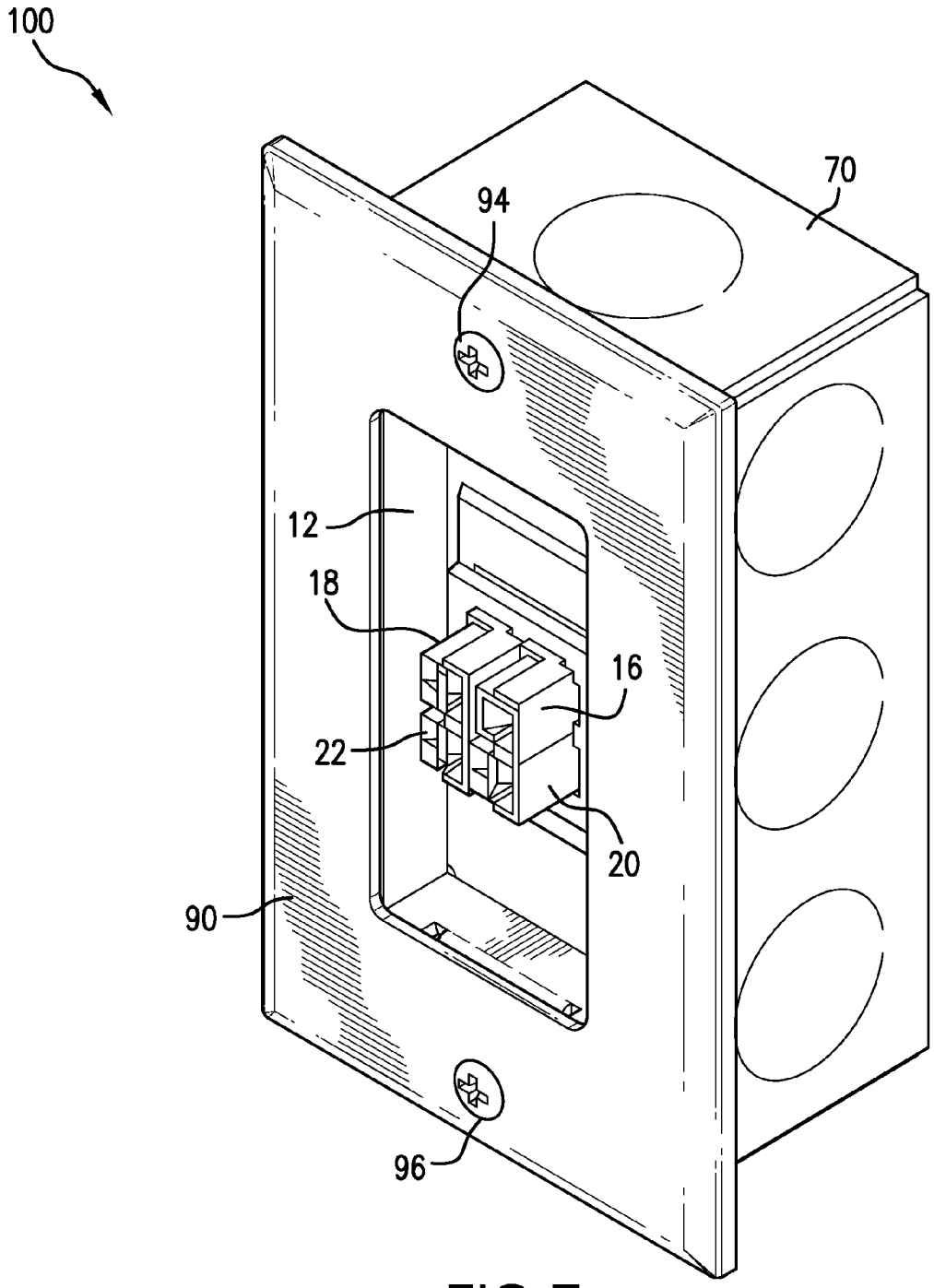
FIG. 7 is a perspective view of the completely assembled electrical power outlet of the present invention.

As shown in FIG. 6, portion 60 of frame 12 includes threaded opening 80 and portion 62 of frame 12 includes opening 82. The electrical power outlet of the present invention further comprises face plate 90. Face plate 90 has an opening 92 which has a size that allows access to electrical connectors 16, 18, 20 and 22. In a preferred embodiment, opening 92 is substantially rectangular. Face plate 90 includes screws 94 and 96 that are configured to be screwed into threaded openings 80 and 82, respectively, of frame 12. In a preferred embodiment, face plate 90 is configured as a Decora® style face plate. Referring to FIG. 7, there is shown completely assembled electrical power outlet 100 of the present invention.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. An electrical power outlet apparatus, comprising:

an outlet box;

an electrical connector insert removably attached to the outlet box, the electrical connector insert comprising a frame and a powerpole connector assembly attached to the frame, wherein the powerpole connector assembly has only four powerpole connectors that are arranged in two columns wherein each column has two powerpole connectors and wherein each powerpole connector has an internal electrical contact and a rear, wire receiving channel for receiving and locking in place a corresponding electrical wire, each powerpole connector being configured to be mated to a complementary powerpole connector;

a plurality of electrical wires, each electrical wire having an end that is disposed through and locked in place within a corresponding wire receiving channel and electrically connected to the corresponding electrical contact; and a face plate removably attached to the frame of the electrical connector insert and having an opening through which the powerpole connectors protrude.

2. The electrical power outlet apparatus according to claim 1 wherein one of the plurality of wires is electrically connected to the frame so as to electrically connect one of the powerpole connectors to electrical ground.

* * * * *